United States Patent [19]

Bruck et al.

[11] Patent Number: 4,628,697

[45] Date of Patent: Dec. 16, 1986

[54] AIR-FLOW TEMPERATURE AND HUMIDITY MANAGEMENT FOR MAINTAINING FRESHNESS OF DELICATE PRODUCE

[75] Inventors: Anthony J. Bruck; Stephen N. Hazen, both of Lake Helen, Fla.

[73] Assignee: Convex Display Systems, Inc., Lake Helen, Fla.

[21] Appl. No.: 778,499

[22] Filed: Sep. 20, 1985

[51] Int. Cl.[4] ..... A47F 3/04

[52] U.S. Cl. ..... 62/89; 62/255; 220/252

[58] Field of Search ..... 62/249, 255, 256, 417, 62/89; 220/252, 337, 377; 49/171; 312/138 R; 206/45.31, 44.12; 211/126, 4, 127

[56] References Cited

U.S. PATENT DOCUMENTS

| | | | |
|---|---|---|---|
| 2,626,483 | 1/1953 | Service | 47/30 |
| 2,793,925 | 5/1957 | Rosen | 312/138 R |
| 2,956,420 | 10/1960 | Replogle | 62/256 |
| 3,200,957 | 8/1965 | Morin | 211/1 |
| 3,585,050 | 6/1971 | Singer et al. | 99/357 |
| 3,999,680 | 12/1976 | Cho | 220/369 X |
| 4,034,849 | 7/1977 | Zakrajsek | 206/45.15 |
| 4,085,986 | 4/1978 | Taub | 312/236 |
| 4,392,326 | 7/1983 | Boria | 47/28 |
| 4,508,235 | 4/1985 | Steele et al. | 215/307 |

*Primary Examiner*—William E. Wayner

*Attorney, Agent, or Firm*—Cushman, Darby & Cushman

[57] ABSTRACT

A forwardly and downwardly sloping display of tender, delicate, loose exposed produce or the like, which is continually bathed in a current of cool air, is partially covered by open-ported transparent domes which permit physical access to the produce for inspection, selection and withdrawal without need for opening or removal of the domes. An important effect of use of the domes is to significantly reduce moisture loss from the produce, while permitting sufficient interchange of air through the dome port to maintain desired coolness and restrict the growth of spoilage microorganisms.

12 Claims, 4 Drawing Figures

AIR-FLOW TEMPERATURE AND HUMIDITY MANAGEMENT FOR MAINTAINING FRESHNESS OF DELICATE PRODUCE

BACKGROUND OF THE INVENTION

Referring to FIG. 1, it is now a conventional practice in modern supermarkets and other places where fresh fruits, vegetables and other moist and tender foods and the like are maintained on display for selection, purchase or consumption in a non-packaged or open-packaged condition, to continually bathe that merchandise in a gentle current of cool air. Where that air is cooler than ambient air, as is generally the case, it is practical to display the produce or the like in a forwardly and downwardly sloping, upwardly open array 10 of receptacles 12 of loose and/or exposed produce P, to input cool air CA to the display array along its upper, rear margin, e.g., through a series of forwardly opening outlets 14, and to collect the air stream CA through a series of rearwardly opening inlets 16 arranged along the lower, front margin of the display surface 10.

The display surface 10 is perimetrically surrounded by an upstanding wall 17, e.g., about ten centimeters high, so that by using proper airflow management, the volume of space defined in the surface 10 up to a sloping level above that of the displayed produce P, e.g., up to but not substantially above the upper margin 18 of the upstanding wall 17 can be kept bathed in a gentle current of cool air.

Out of view, the air stream CA collected in the inlets 16 is cooled, dehumidified or humidified, if desired, filtered and pumped to the air outlets 14. Recycle can vary from zero to total, with make-up air being drawn from the ambient space and non-recycled air being lost to the ambient space. Conventional display cases, including refrigeration systems for accomplishing such air flow management are well known and commercially available and will be adequately understood by those skilled in the art without need for further details to be presented herein.

It is well known that the ability of air to carry moisture in vapor form is temperature-sensitive, notably that cooler air has a lower moisture-carrying capacity than warmer air. It is further known that the merchandising of delicate produce in loose form or in open containers is a delicate art, in that a dynamic balance must be continually sought between maintaining a fresh, crisp look, feel and smell to the goods, and rapidly turning the inventory on the one hand, with minimizing the effect that inventory shrinkage through spoilage, and distress selling have on profit margins and image.

The conventional airflow management system is an important tool which enjoyed considerable success in the trade in helping to shift that balance in the direction of higher profitability and better product appearance and image. However, as with many improvements, once use of the improvement has become fairly ubiquitous, it is largely taken for granted, and rather than being appreciated for the advantage the improvement represents, the natural human tendency is to focus on the lack of perfection inherent in the improvement and thus the need for further improvements.

So, too, in the present instance those in the trade remain dissatisfied with the rate that the conventional produce-keeping system permits some tender produce to age and deteriorate before it can be dispensed, sold or consumed from the display. It is seen that a large part of the problem is the fact that in the conventional system, there is too great a flow of too turbulent cool air in region closest to exposed surfaces of the produce. The result is too rapid moisture-loss by the produce with attendant wilting, loss of crispness and apparent freshness.

In some instances, the answer would be to simply cover the bins, trays, recesses, mounds of produce with transparent films, domes or lids of clear plastic, glass or the like.

However, for many types of delicate, tender produce and for many merchandising situations, there are at least three reasons why such an answer would be wrong. First, cutting-off the potential consumer from being able to directly sense the merchandise without an intervening barrier can be a serious mistake. Some people will not take the step of lifting a lid, removing a cover or the like, to get at the produce; it takes an additional hand to do that, which can be difficult if the person is already carrying a package or purse and needs to use tongs to turn-over, select and abstract the produce. And there are many who, once having removed a lid or lifted a covering will not properly replace it. Second, cutting off the produce from direct heat exchange relation with the cool air reduces the efficiency of the refrigeration process. And third, by completely encapsulating the produce, humidity within the enclosure can rise to such a level that losses due to more rapid growth of yeasts, molds, algae, fungi and bacteria can become intolerable. Condensate forming on the inner surface of the enclosure due to the high humidity can obscure the produce, and thus defeat the purpose of putting it on display.

The present invention grew out of attention paid by the inventor to the current level of dissatisfaction in the trade, with a view towards finding a solution which would give its users a competitive edge in comparison with users of the heretofore conventional practices and equipment.

SUMMARY OF THE INVENTION

A forwardly and downwardly sloping display of tender, delicate, loose exposed produce or the like, which is continually bathed in a current of cool air, is partially covered by open-ported transparent domes which permit physical access to the produce for inspection, selection and withdrawal without need for opening or removal of the domes. An important effect of use of the domes is to significantly reduce moisture loss from the produce, while permitting sufficient interchange of air through the dome port to maintain desired coolness and restrict the growth of spoilage microorganisms.

The principles of the invention will be further discussed with reference to the drawings wherein a preferred embodiment is shown. The specifics illustrated in the drawings are intended to exemplify, rather than limit, aspects of the invention as defined in the claims.

DETAILED DESCRIPTION

Figure 1:
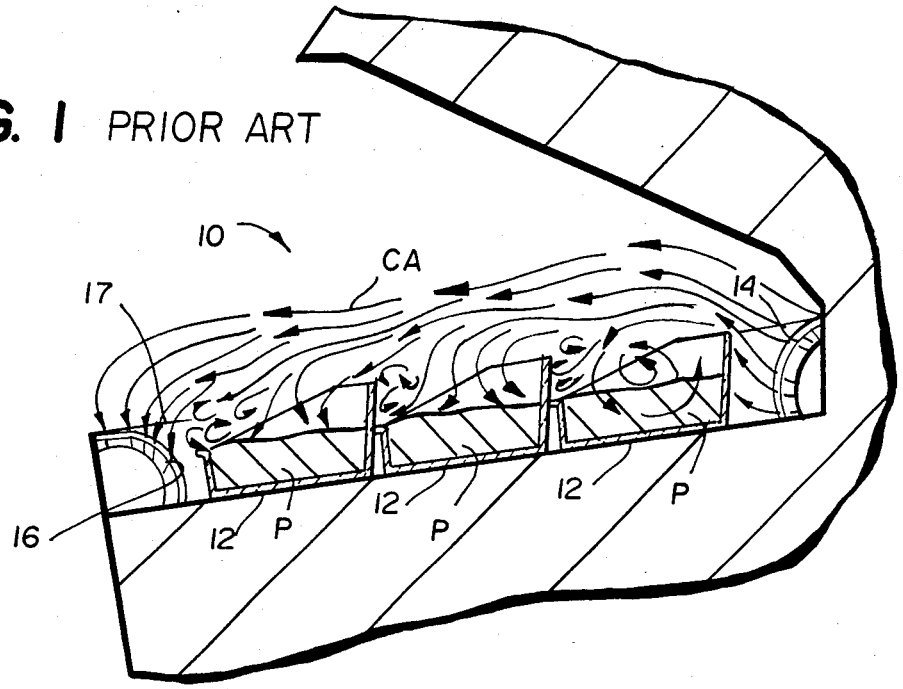
FIG. 1 PRIOR ART
FIG. 1 is a vertical fragmentary longitudinal sectional view of a PRIOR ART display for loose, exposed produce.
Figure 2:
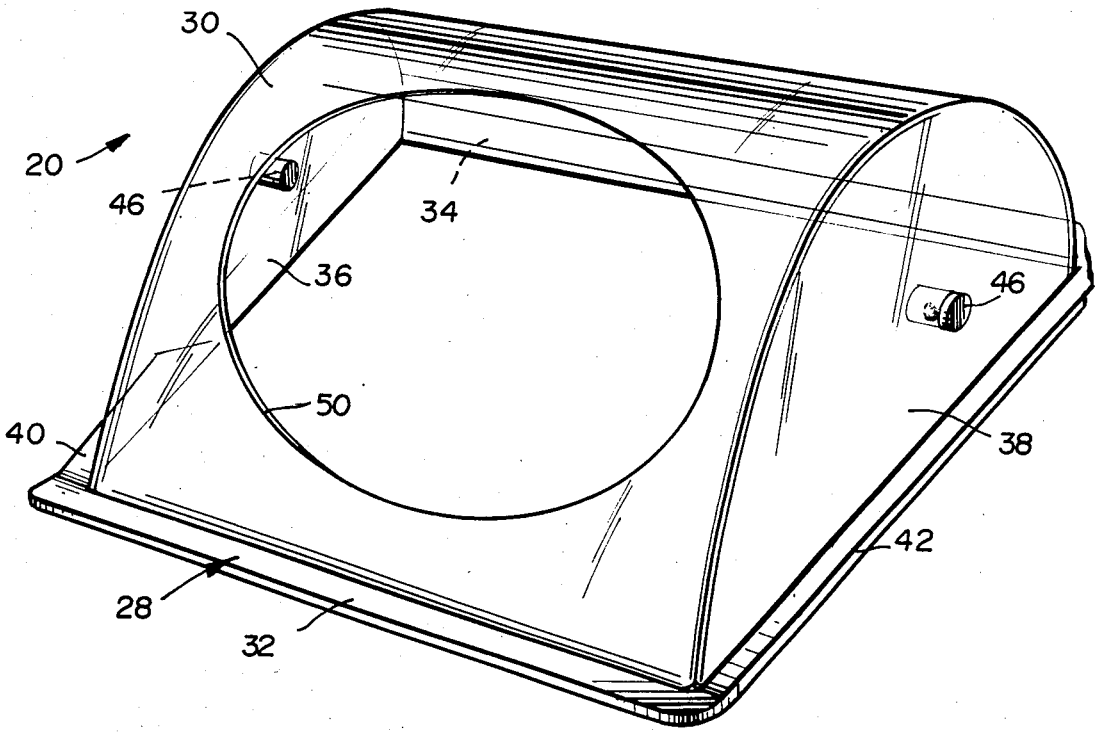
FIG. 2 is a perspective view of an open-ported dome for covering one produce-filled well or one mound of produce on a display such as the one depicted in FIG. 1.

The subject matter of FIG. 1 has been described hereinabove, in the Background section.

Figure 4:
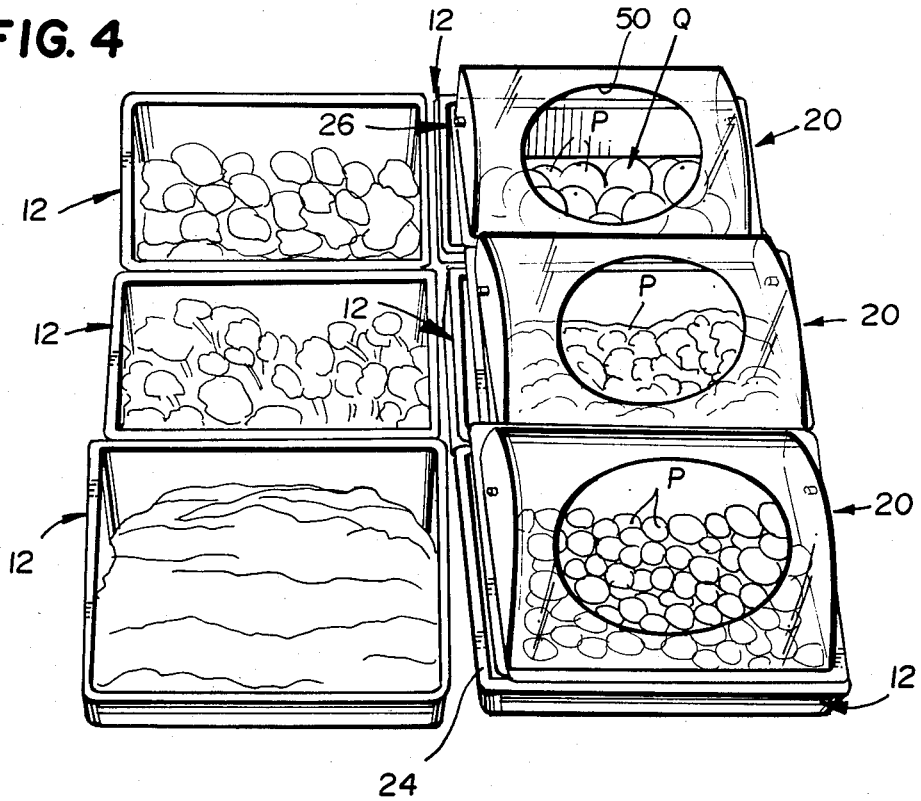
FIG. 4 is a fragmentary perspective view of the apparatus of FIG. 3 from the front and above, showing some of the wells of produce covered by open-ported domes of the present invention.

In accordance with principles of the invention, at least one collected quantum Q of loose, exposed delicate produce or the like P, displayed on a display surface is protected by being partially covered by an open-ported dome 20, as shown in FIG. 4.

In the preferred embodiment, there is provided a forwardly and downwardly sloping upwardly open surface array 10 of sites for displaying respective quantums Q of loose and/or exposed produce P. The surface 10 slants down at an angle typically of approximately 13.5 degrees. Each site may be constituted by a well, recess, dish, depression or the like integrally formed in the surface, or as a separately formed receptacle 12 set into a framework (not shown), or simply a flat respective space on the surface 10 onto which a quantum of produce P can be mounted.

Figure 3:
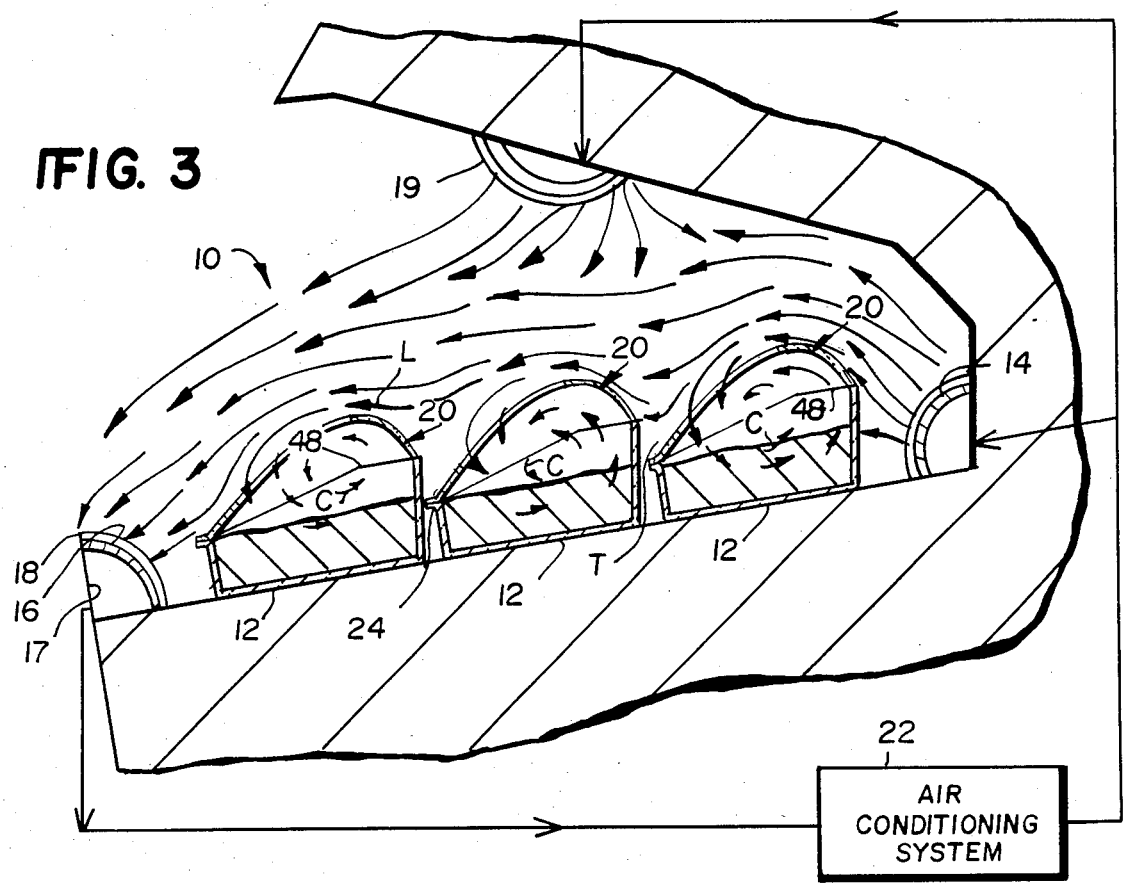
FIG. 3 is a vertical fragmentary longitudinal sectional view similar to FIG. 1, but showing an embodiment of the present invention being put to practice.

As shown in FIG. 3, the surface 10 is bounded by an upstanding peripheral wall 17 with an upper margin at 18. Cool air issues from outlets 14 along the inside of the wall 16 at the rear margin of the surface 10, flows over the displayed merchandise and is collected in the inlets 16. Between the inlets 16 and outlets 14, a conventional refrigeration system and air blower, optionally a humidifier and a filter are provided, as is schematically illustrated at 22. In certain installations a portion of the cool air may fall from a series of outlets 19 which overlie the display surface. The perimeter of each produce site 12 may be constituted by a receptacle such as, for instance, an upstanding perimetrically extending rim 24, a lip, a channel, a flange, or simply a bounding flat surface or the like.

Although in accordance with the principles of the present invention, each of the sites 12 could be covered by an open-ported dome 20, in practice not all produce requires so much protection. For instance, some of it naturally or through processing has acquired a waxy coating which acts as a vapor barrier. So it also is in accordance with the principles of the present invention to cover only some of the sites with open-ported domes 20.

Although each site 12 that is covered by a dome 20 preferably is covered by its own individual dome, it would be within the scope of the invention to provide a dome which covers two or more adjoining sites extending widthwise and/or depthwise of the array. Further, it is within the scope of the invention to provide domes 20 which are integrally or by means of assembly interconnected along their respective adjoining margins.

The domes 20 may have perimetrical margins which simply rest on the surface 10, or detachably connect to it, and/or are hinged to it, e.g., by hinges 26.

The domes 20 preferably are made of thermoformed synthetic plastic material which is transparent, an example being polystyrene. The particular plastic material used for making the domes 20 is not part of the present invention. Any suitable plastic material which can be molded, and which is appropriate for use in contact with fresh produce may be used.

In the instance shown, each dome 20 is about thirty centimeters square, is bounded by a laterally outwardly projecting flange 28, has a top wall 30 which arches between the front and rear portions 32, 34 of the flange 28, and two opposite end walls 36, 38 extending between opposite end margins of the top wall 30 and the left and right portions 40, 42 of the flange 28. The top wall 30 in this example arches to a maximum of about ten centimeters above the slanting level of the flange 28. By preference, the top wall 30 is not of constant radius, but rather it has a radius throughout its forward two-thirds that is about three times as great as its radius in its rear third, so that the dome in longitudinal vertical section has a profile approximately that of a half of a conventionalized depiction of a heart.

In the instance depicted, the hinges 26 are provided as coaxially outwardly projecting trunnions 46 externally provided on the left and right end walls 36, 38 of the dome 20 for pivotal mounting in upstanding flanges 48 of the receptacle at the respective site 12. The trunnions 46 are shown centered on the axis of curvature of the shorter-radius, rear portion of the top wall 30.

In accordance with the principles of the present invention, each open-ported dome 20 is provided with an opening 50 in its top wall 30. The opening 50 preferably is bounded by a round perimeter, e.g., one which is oval, elliptical, ovoid, circular, round-cornered rectangular or the like. Each opening 50 is smaller in width and in length than the top wall 30, and is sufficiently centered that by preference it is bounded about all of its periphery by some of the top wall 30. By preference the opening 50 is centered on and principally exists as an opening through the larger diameter forward portion of the top wall 30, e.g., so much so that it could be accurately said to open somewhat forwardly, as well as upwardly, but to have its upper and rear extent located on the crest of the dome.

The size of the opening 50 is preferably such as to permit a customer to reach in through it with a set of food tongs, rearrange and turn for examination each of several loose pieces of fresh fruit, vegetable material and the like, and to withdraw the selected pieces through the opening, all without needing to lift, remove, pivot or disturb the dome 20. The diameter of an opening 50 for instance may be about seven times that of a standard Brussels sprout.

The domes 20 may conveniently be factory assembled to receptacles 12 and the two sold as a unit. Or the domes 20 may be separately provided, e.g., for retrofitting existing receptacles.

Although the present inventor does not believe he should be held to any theory as to why the invention works, for whatever value it may have to those skilled in the art the present inventor is willing to expose, here, his current thinking as to the mechanism of operation of the apparatus and method of his present invention. To that end, corresponding sets of arrows indicating air-movement have been applied to FIG. 1 (PRIOR ART) and to FIG. 3 (the system of the invention) for comparison.

Where open-ported domes of the invention are in use, a rather consistent pattern of air flow is produced in which turbulence is confined to the small areas T, linear air flow occurs over most of the domed display as is indicated at L. Under each open-ported dome air turns in a slow circular pattern C, powered mainly by a very small ingress of air from the primary linear flow path over the domes, as well as by a slow egress of air from within the domes through the ports, due to slightly lower pressure at L than at C, owing to the Bernoulli effect. Thus, the temperature of the produce remains at the desired level due to cooling from the air both inside and outside the dome but, because there is little actual transfer of air to cause loss of moisture from the produce, the humidity within the domes remains high, and the temperature difference between the inside and outside is so small that fogging of the domes is insignificant.

The area and degree of forward tilting of the display surface; the height of the perimetrical wall; the refrigerated air flow rate, temperature and humidity; the size, number and placement of the air outlets and inlets to and from the display surface; the refrigeration and air pumping system; the amounts of produce P in each quantum Q; the degree of comminution and/or looseness of that produce and its identity, all may be as is utterly conventional present good practice in the trade.

Although no doubt there are other varieties of produce and non-food items with which the apparatus and process of the invention may be advantageously put to use in accordance with the principles of the invention, the inventor wishes to provide the following list of examples of produce on which the invention may be advantageously put into practice: alfalfa sprouts, baby beets, baby bok choy, baby carrots, baby cauliflower, baby celery, bamboo shoots, bean sprouts, black radishes, Mexican finger bananas (burros), brussels sprouts, carambola, Nopales cactus leaves, cardoon, cherimoyas, Hantanka chiles, Anaheim green chiles, Poblano chiles, Fresno green chiles, Serrano chiles, other chiles, Chinese long beans, clover radish sprouts, cocktail avocados, Japanese white radish (daikon), dandelion greens, elephant garlic cloves, ginger root, French green beans, Japanese eggplant, jicama, kumquats, lychees mushrooms, onions, parsley root, passion fruit, pearl onions, persimmons, quince, rappini, red bananas, rhubarb, salad, shallots, snow peas, sugar snap peas, banana squash, butternut squash, chayote squash, table queen squash, azuki and mung bean sprouts, Jerusalem artichokes, tamavindos, taro root, water chesnuts, watercress, yucca root, horseradish, spaghetti squash, leeks, okra, limes, cauliflower florets and broccoli florets.

It is consistent with the principles of the invention to have one open-ported dome cover more than one quantum of produce or the like, e.g., to have the same dome extend over two or more adjacent piles, and it is consistent with the principles to have two or more of the open-ported domes arranged in a row or in a column and physically interconnected regardless of whether the underlying receptacles are connected or are separate. Although it is preferred that the domes be hinged to the respective receptacles, e.g., to facilitate replenishing of the quantums of produce covered thereby, it is neither necessary nor usually desired that the domes be lifted by the consumer for inspection or abstraction of the produce, since the open ports are sufficiently large as to accommodate such activities.

The term "produce" is used herein in its broadest sense to encompass primarily but not exclusively edible fruits, vegetables and the like, but also other similarly tender and delicate products which are in need of temperature, humidity and air-flow management.

By using the currently most preferred embodiment of the apparatus and method of the invention described herein, it is possible to maintain the temperature within the open-ported dome-covered receptacles at within 1° F. of the temperature of the flowing blanket of conditioned air outside the receptacles, to reduce the shrinkage rate by 70 to 95 percent relative to that of uncovered, sensitive produce, to substantially and strongly visually apparently reduce the rate of browning of produce such as cauliflower, mushrooms, bean sprouts, white radishes that usually become increasinging browner upon exposure, and accomplish the foregoing without accumulating an obscuring coating of moisture condensate on the dome-covered receptacles.

It should now be apparent that the air-flow, temperature and humidity management for maintaining freshness of delicate produce as described hereinabove, possesses each of the attributes set forth in the specification under the head "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. Apparatus for practicing air-flow, temperature and humidity management of produce for maintaining freshness thereof, comprising:

means defining a support surface constructed and arranged for supporting at least one quantum of physically exposed produce within the perimeter of such support surface;

an upstanding perimetrical wall bounding said support surface;

means for providing a flowing blanket of conditioned air of substantial depth over said support surface along a path extending across said surface; and an open-ported dome means cooperating with said support surface to enclose at least one quantum of said produce but for providing open access to each so-enclosed quantum through upwardly open port means thereof, each such port means being at least generally round and of sufficient breadth as to permit inspection, manipulation and abstraction therethrough of produce from the respective quantum;

each said open-ported dome means being constructed and arranged so as to substantially diminish loss of moisture from the respective enclosed quantum to said flowing blanket of conditioned air in comparison with moisture loss rate therefrom in the absence of enclosure by the respective open-ported dome means.

2. The apparatus of claim 1, wherein:

said means for providing a flowing blanket of conditioned air of substantial depth is constructed and arranged to provide cooler-than-ambient air.

3. The apparatus of claim 2, wherein:

said support surface is tilted so as to have a higher edge opposite to a lower edge;

said means for providing a flowing blanket of conditioned air of substantial depth is constructed and arranged so that said path extends from the vicinity of said higher edge to the vicinity of said lower edge;

said upstanding perimetrical wall is constructed and arranged to extend up to a level sufficient to cause said means for providing a flowing blanket of conditioned air of substantial depth, to blanket said open-ported dome means.

4. The apparatus of claim 3, wherein:

said open-ported dome means includes at least two open-ported domes supported on said support surface, these domes being disposed in a series which extends along said path.

5. The apparatus of claim 4, wherein:

each said open-ported dome includes a generally cylindrically curved top wall, two opposite end walls and a supporting means constructed and arranged for supporting that dome on said support surface perimetrically of a respective quantum of produce.

6. The apparatus of claim 5, wherein:

said top wall is of varying radius of curvature, having a larger radius of curvature between the upper extent thereof and the extent thereof which lies furthest downstream along said path, than it does between the upper extent thereof and the extent thereof which lies furthest upstream along said path.

7. The apparatus of claim 6, wherein:

said port through each said open-ported dome is confined between said upper extent of said top wall and said furthest downstream extent of said top wall.

8. The apparatus of claim 5, further including:

an upwardly open receptacle forming a corresponding part of said support surface; and said supporting means includes hinge means hingedly joining said open-ported dome to said upwardly open receptacle so that, when in a closed condition, said open-ported dome acts as an enclosure for said receptacle, with said port of said open-ported dome providing access through said open-ported dome to said receptacle;

said receptacle being constructed and arranged to contain at least one said quantum of produce therein.

9. The apparatus of claim 3, wherein:

said open-ported dome means comprises a plurality of open-ported domes made of transparent synthetic plastic material.

10. A method for improving the practice of air-flow, temperature and humidity management of produce for maintaining freshness thereof, comprising:

supporting at least one quantum of physically exposed produce on a surface bounded by an upstanding perimetrical wall;

blanketing said support surface with a blanket of cooler-than-ambient air flowing across said surface with a depth which is at least as thick as the greatest extent of said at least one quantum of produce above said surface;

enclosing said at least one quantum of said produce, cooperatively with said support surface, by an open-ported dome but for providing open access to each so-enclosed quantum through an upwardly opening port through such dome, such port being at least generally round and of sufficient breadth as to permit inspection, manipulation and abstraction therethrough of produce from the respective quantum.

11. The method of claim 10, wherein:

the support surface is tilted and the blanket flows down along such tilt.

12. The method of claim 11, wherein:

each said dome has a top wall which is generally cylindrically curved, with its port being confined between the uppermost and furthest downstream extents of such dome, relative to said support surface and said flowing blanket.

* * * * *